United States Patent [19]

Kawai

[11] Patent Number: 4,663,808

[45] Date of Patent: May 12, 1987

[54] SAFETY BELT BUCKLE

[75] Inventor: Osamu Kawai, Fujisawa, Japan

[73] Assignee: NSK Warner K. K., Tokyo, Japan

[21] Appl. No.: 671,682

[22] Filed: Nov. 15, 1984

[30] Foreign Application Priority Data

Nov. 30, 1983 [JP] Japan ..... 58-183705[U]

[51] Int. Cl.[4] ..... A44B 11/26

[52] U.S. Cl. ..... 24/641; 24/645; 24/651

[58] Field of Search ..... 24/633, 636, 637, 640, 24/641, 643, 645, 651; 297/468; 280/801

[56] References Cited

U.S. PATENT DOCUMENTS

| | | | |
|---|---|---|---|
| 690,659 | 1/1902 | Ney | 24/645 X |
| 3,146,846 | 9/1964 | Gutshall | 280/801 X |
| 4,194,764 | 3/1980 | Grimm | 280/801 |
| 4,338,746 | 6/1983 | Krautz et al. . | |

FOREIGN PATENT DOCUMENTS

| | | | |
|---|---|---|---|
| 1965181 | 9/1971 | Fed. Rep. of Germany | 24/637 |
| 3021796 | 12/1981 | Fed. Rep. of Germany | 24/641 |
| 2336147 | 7/1977 | France . | |
| 69008 | 6/1981 | Japan . | |

*Primary Examiner*—Francis K. Zugel
*Assistant Examiner*—James R. Brittain
*Attorney, Agent, or Firm*—Shapiro and Shapiro

[57] ABSTRACT

A two-stage latch type safety belt buckle is provided with a first latch member directly engaged with a tang and a second latch member for preventing the tang from being disengaged from the first latch member. The second latch member is a two-layer structure, and the first latch member partly extends between the two layers. The second latch member is brought into engagement with the first latch member in a wall portion connecting the two layers together to thereby lock the first latch member in a position in which it is engaged with a tang.

8 Claims, 4 Drawing Figures

SAFETY BELT BUCKLE

BACKGROUND OF THE INVENTION

1. Field of the Invention

This invention relates to a so-called two-stage latch type safety belt buckle provided with a first latch member directly engaged with a tang and a second latch member for preventing the tang from being disengaged from the first latch member.

2. Description of the Prior Art

Various buckles of this type have heretofore been proposed. In these buckles, the second latch member is provided at a location adjacent to a space in which the first latch member is disposed, but not overlapping such space and correspondingly, the dimensions of a base member which supports these two latch member become larger and further, the entire buckle becomes larger, and when the second latch member is engaged with the first latch member to lock the first latch member in a position in which it is engaged with the tang, the manner of engagement is such that the area of the second latch member in the direction of its thickness receives the force from the first latch member, and this has led to a problem that a large engaging area cannot be secured for the two latch members and the surface pressure is increased to create an impression.

SUMMARY OF THE INVENTION

It is therefore an object of the present invention to provide a buckle which solves the above-noted problems. For this purpose, in the buckle according to the present invention, the second latch member is made into a two-layer structure and the first latch member is disposed while being partly extended between the two layers, and the second latch member is brought into engagement with the first latch member in a wall portion connecting the two layers together to thereby lock the first latch member in a position in which it is engaged with the tang.

DESCRIPTION OF THE PREFERRED EMBODIMENTS

Figure 1:
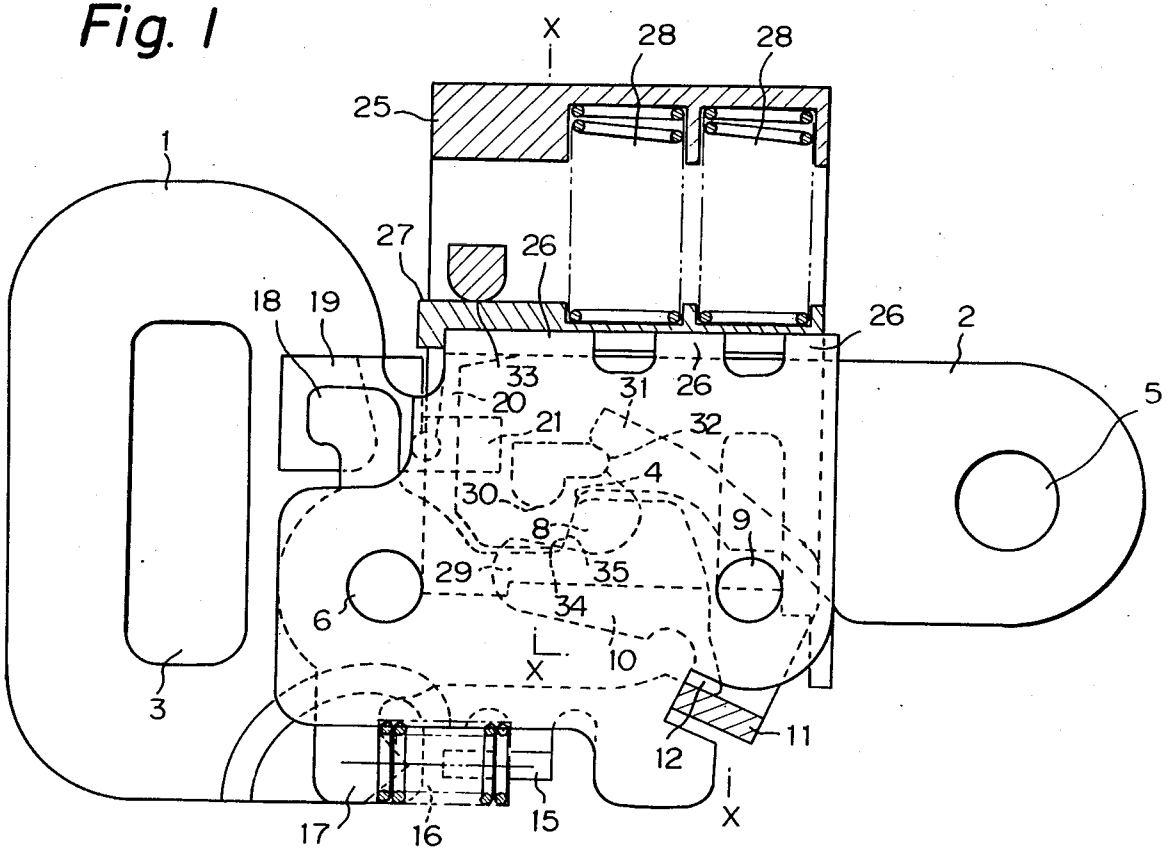
FIG. 1 is a partly broken-away front view of a first embodiment of the present invention.

Some embodiments of the present invention will hereinafter be described by reference to the drawings. Each of the following embodiments is used as a buckle mounted on the inner side of an active belt or as an emergency-operable buckle of an automatic belt Referring to FIGS. 1 to 3 which shows a first embodiment, a base 1 has a portion having a U-shaped cross-section forming an insertion space for a tang 2 and a portion formed with a slot 3 for mounting a belt, not shown The tang 2 has an engaging portion 4 in the form of a cut-away and a circular hole 5 into which a tightening member is inserted to be mounted on the vehicle body side.

On the U-shaped portion of the base 1, a first latch member 7 is mounted for pivotal movement about a shaft 6. The first latch member 7 has a projection 8 for meshing with the engaging portion 4 of the tang 2. On the right part of the U-shaped portion of the base 1 as viewed in FIG. 1, a second latch member 10 is mounted for pivotal movement about a shaft 9. The second latch member 10 is of a two-layer structure and has a side wall portion 11 connecting the two layers together. The first latch member 7 is disposed so as to be embraced by the U-shaped portion of the base 1, whereas the second latch member 10 is disposed so as to embrace the U-shaped portion.

The first latch member 7 further has an engaging surface 12 in the right lower part of FIG. 1 for engaging the side wall portion 11 of the second latch member 10. A spring 16 is mounted on a spring holder 15 formed by bending the base 1, and this spring 16 is engaged with the leg portion 17 of the first latch member 7 and normally biases the first latch member clockwise about the shaft 6. The other leg portion 18 of the first latch member 7 is fitted in a spacer 19 of resin shown in the left upper part of FIG. 1. The spacer 19 is provided with a spring portion 20 and an arm portion 21. The arm portion 21 juts out over the upper layer plate of the U-shaped portion of the base 1, whereas the spring portion 20 comes into the U-shaped portion of the base 1 with the leg portion 18 of the first latch member 7 as the first latch member 7 pivotally moves, thereby pushing the tang 2 out of the base 1, and also serves to eliminate the back-lash of the tang 2 in the left and right directions as viewed in FIG. 1 during the engagement of the tang 2 with the first latch member 7.

Above the base 1 as viewed in FIG. 1, a push button 25 as operating means is vertically movably provided in a state in which it embraces the base 1. The push button 25 is biased upwardly as viewed in FIG. 1 by a spring 28 bridged between a spring holder 27 mounted on the side wall 26 of the base 1 and the push button 25. The push button 25 is formed with an engaging surface 30 engageable with the upwardly facing surface of the arm portion 29 of the second latch member 10 when the button 25 is moved down, to thereby impart a counter-clockwise rotational force to the second latch member 10 about the shaft 9, an engaging surface 32 engageable with the other arm portion 31 of the second latch member 10 to thereby prevent the second latch member 10 from rotating counter-clockwise about the shaft 9, and an engaging surface 33 engageable with the arm portion 21 of the spacer 19 when the engagement between the tang 2 and the first latch member 7 is not released for some reason or other even if the push button 25 is depressed, to thereby rotate the first latch member 7 clockwise and ensure the dissociation thereof.

Also, the left engaging surface 34 of the engaging portion 4 of the tang 2 as viewed in FIG. 1 and the left engaging surface 35 of the projection 8 of the first latch member 7 form an inclined surface so that the tang 2 and the first latch member 7 become free to slip out.

Operation of the first embodiment will now be described on the basis of the above-described construction.

Figure 2:
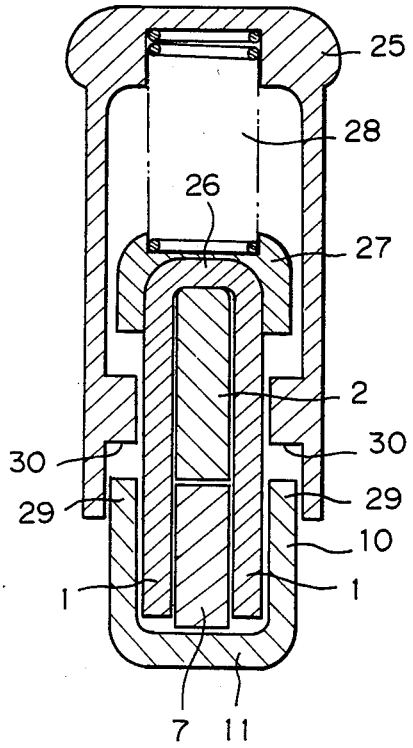
FIG. 2 is a cross-sectional view taken along line X—X of FIG. 1.

FIG. 1 and FIG. 2 which is a cross-sectional view taken along line X—X of FIG. 1 show the engaged state of the tang 2 and in this state, the tang 2 inserted in the base 1 has one side thereof limited by the side wall portion 26 of the base 1 and the other side thereof limited by the projection 8 of the first latch member 7 and the pivot shaft 9 of the second latch member 10, and the engaging surface 34 of the tang 2 is in engagement with the engaging surface 35 of the first latch member 7.

At this time, the first latch member 7 is biased away from the tang 2 by the spring 16, but the engaging surface 12 of the first latch member 7 is engaged with the side wall portion 11 of the second latch member 10 and further, the second latch member is biased in a clockwise direction as viewed in FIG. 1, namely, in a direction to bring the engaging surface 12 into engagement with the side wall portion 11, by the spring 28 through the enagement between the arm portion 31 of the second latch member and the engaging surface 32 of the push button 25 and therefore, the first latch member 7 is locked in engagement with the tang 2. Thus, the tang 2 is reliabled coupled in the base 1.

When, in the state of FIG. 1, the push button 25 is depressed downwardly against the biasing force of the spring 28, the engagement between the engaging surface 32 of the push button 25 and the arm portion 31 of the second latch member 10 is first released to permit counter-clockwise rotation of the second latch member 10 as viewed in FIG. 1, whereafter the engaging surface 30 of the push button 25 bears against the arm portion 29 of the second latch member 10 to push the second latch member 10 downwardly as viewed in FIG. 1, and the side wall portion 11 of the second latch member 10 becomes disengaged from the engaging surface 12 of the first latch member 7. The tang 2 and the first latch member 7 are free to slip out and the first latch member 7 is normally biased clockwise as viewed in FIG. 1 by the spring 16 and therefore, at this point, the first latch member 7 pushes out the tang 2 by the leg portion 18 through the spring portion 20 of the spacer 19 while rotating clockwise and dissociates the tang 2.

Figure 3:
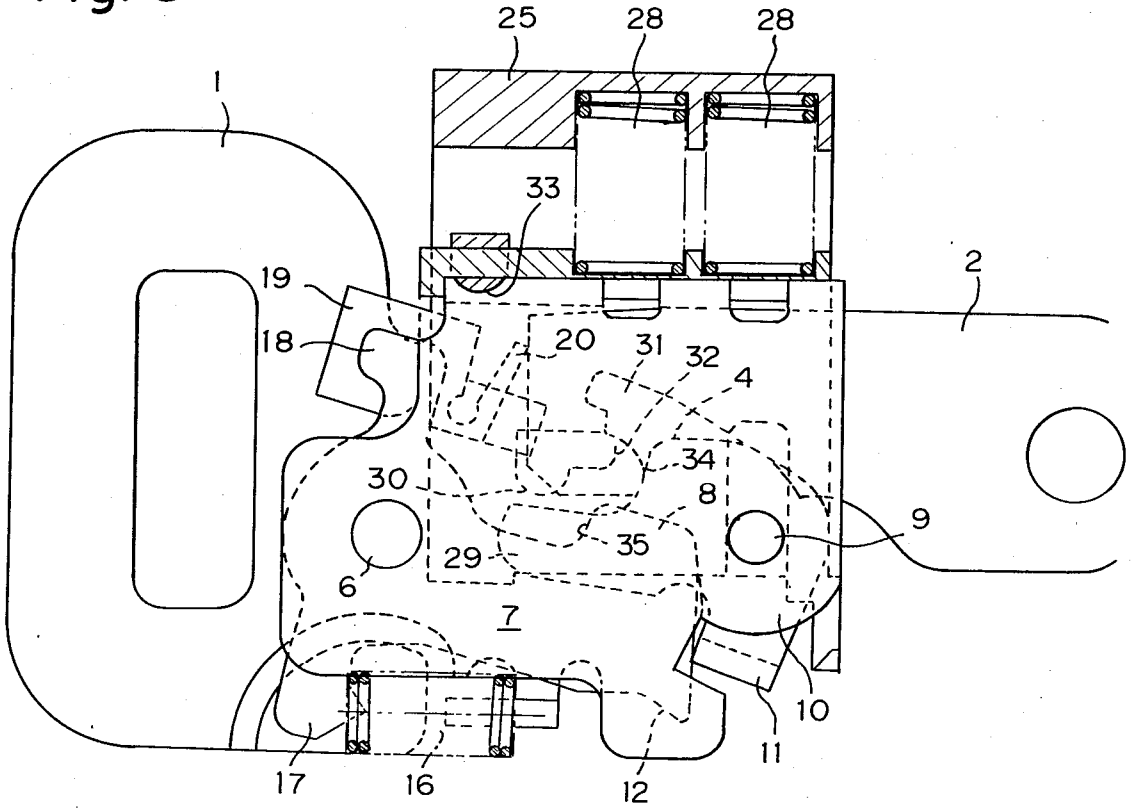
FIG. 3 is a front view illustrating the operation of the first embodiment.

This state is shown in FIG. 3. In this manner, the next insertion of the tang 2 is waited for.

When, in the stand-by state of FIG. 3, the tang 2 is inserted into the base 1, the first latch member 7 is rotated counter-clockwise about the shaft 6 while the spacer 19 is pushed to the left as viewed in FIG. 3 by the fore end of the tang 2. In accordance therewith, the second latch member 10 is somewhat rotated counter-clockwise by the first latch member 7 against the biasing force of the spring 28 which acts on the second latch member 10 through the engaging surface 32 of the push button 25 and the arm portion 31 of the second latch member 10, whereafter the second latch member comes back to its initial position and the side wall portion 11 and the engaging surface 12 of the first latch member 7 come into engagement with each other. At this time, the projection 8 of the first latch member 7 and the engaging portion 4 of the tang 2 also come into engagement with each other and thus, the engaged state of FIG. 1 is realized. That is, as will be seen from the foregoing description of the operation, the spring 28 for biasing the push button 25 functions also as the biasing means for biasing the second latch member 10 so that the second latch member 10 assumes the locking position of FIG. 1 when the first latch member 7 comes to a position for engagement with the tang 2, and the spacer 19 and the leg portion 18 together constitute return means for bringing the first latch member 7 to the engaged position of FIG. 1 when the tang 2 is inserted into the base 1.

A second embodiment will now be described by reference to FIG. 4.

The differences of the second embodiment from the first embodiment are as follows. Firstly, the pivot shaft 106 of a first latch member 107 is positioned at the right of the position for engagement between the engaging surface 134 of a tang 102 and the engaging surface 135 of the first latch member 107 as viewed in FIG. 4. Secondly, means for pushing out the tang 102 is provided by a slider 50 and a spring 51 provided discretely from the first latch member 107 and accordingly, when a push button 125 is depressed and a second latch member 110 is rotated clockwise by the engagement between an engaging surface 130 and an engaging surface 129 to release the locking of the first latch member 107, the slider 50 pushes out the tang 102. At this time, the engaging surface 134 of the tang 102 and the engaging surface 135 of the first latch member 107 are free to slip out. Thirdly, a biasing member for directly biasing the first latch member 107 toward its non-engaged position is absent, but the biasing force of the spring 51 indirectly acts on the first latch member 107. That is, when the slider 50 is slidden to the right as viewed in FIG. 4 by the spring 51, the first latch member 107 is pushed counter-clockwise, i.e., toward its non-engaged position, by downwardly pushing the engaging surface 135 of the first latch member 107 by the engaging surface 134 of the tang 102 through the tang 102. Fourthly, returning the first latch member 107 to its engaged position when the tang 102 is inserted is accomplished by the engagement between the ear portion 55 of the tang 102 and the protrusion 56 of the first latch member 107.

Figure 4:
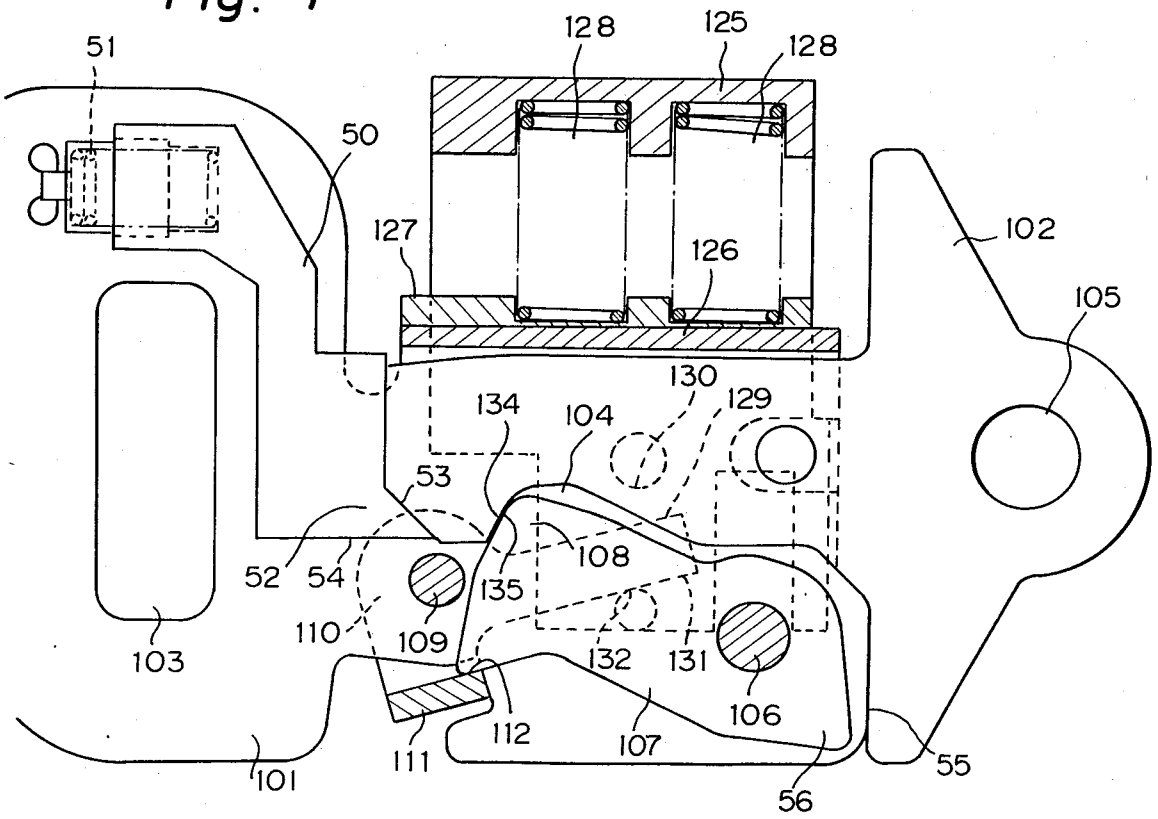
FIG. 4 is a partly broken-away front view of a second embodiment of the present invention.

Fifthly, in order to keep the first latch member 107 and the second latch member 110 in their stand-by position, when the slider 50 slides to the right as viewed in FIG. 4, the underface 54 of the projection 52 thereof passes between the first latch member 107 and the side wall 126 of the base 101 to bring the first latch member 107 into its stand-by position, namely, secure the insertion route of the tang 102, and the second latch member 110 maintains its state with the side surface of the side wall portion 135 thereof bearing against the engaging surface 135 of the first latch member and being biased in a counter-clockwise direction, i.e., in a direction to bear against the first latch member 107, by the engaging surface 131 of the second latch member with the aid of the biasing force of a spring 128 through the projection 132 of the push button.

In the other points, the second embodiment is substantially the same as the first embodiment, and the portions of the second embodiment which correspond to those of the second embodiment are designated by the reference numerals of the first embodiment having 100 added thereto.

In the above-described two embodiments, the second latch member receives the force from the first latch member in the side wall portion thereof not by a compression force but by a tensile force and further, the pivot shaft of the second latch member lies at a position more proximate to the tang insertion path relative to the engaging portions of the two latch members and contributes to reducing the width of the buckle.

According to the present invention, as described above, the first and second latch members are disposed partly in overlapping relationship with each other and therefore, a design which does not require much space becomes possible and the buckle can be made compact in spite of its being of the two-stage latch type and further, the second latch member receives the force from the first latch member by the side wall portion thereof forming a bent portion and thus, the area which receives the force can be made wide, and designing such as reducing the surface pressure is possible.

Furthermore, a design in which the operating means such as the push button for operating the second latch member is proximate to the second latch member is possible and therefore, the second latch member can be directly operated without the necessity of interposing another member between the push button and the second latch member and thus, the structure of the buckle becomes simpler. This is particularly effective in the case of a U-shaped base.

I claim:

1. A safety belt buckle comprising a flat tang having an engaging portion in the same plane as the flat plane thereof, a base having two planes parallel to said tang during the insertion of said tang and a wall portion connecting said two planes together, a first latch member pivotally mounted on said base and having a projection constructed to mesh with the engaging portion of said tang during the insertion of said tang into said base to thereby prevent the draw-out of said tang, biasing means for urging the pivotal movement of said first latch member, releasing the mesh engagement between said first latch member and the engaging portion of said tang and biasing said tang so as to push said tang out of said base, said biasing means comprising a spring member of resin integrally mounted on said first latch member and bearing against the fore end of said tang to impart a force in a push-out direction to said tang, and a compressiion spring disposed between said base and said first latch member and biasing said first latch member so that said first latch member pivotally moves in a direction in which the mesh engagement thereof is released, a second latch member mounted on said base so as to assume a first position in which the second latch member holds the mesh engagement between said first latch member and said tang and a second position in which the second latch member permits the pivotal movement of said first latch member, said second latch member having a wall extending transversely of a portion of said first latch member, said wall being engaged with a portion of said first latch member in said first position and being out of engagement with the portion of said first latch member in said second position, and operating means mounted on said base for controlling the displacement of said second latch member between said first position and said second position.

2. A safety belt buckle according to claim 1, wherein said second latch member comprises two side plates held on said base while embracing the outer sides of opposite ends of a U-shaped groove portion of said base, and a connecting wall connecting said two side plates together, and a projection protruding from said first latch member bears against said wall when said first latch member is in a position in which it meshes with said tang, to thereby hold the mesh engagement of said first latch members.

3. A safety belt buckle having a tang, a base member into which said tang is inserted, a first latch member mounted on said base member for pivotal movement between an engaged position in which said first latch member is engaged with said tang and a non-engaged position in which said first latch member is unengageable with said tang, a second latch member mounted on said base member for pivotal movement between a locking position in which said second latch member holds said first latch member in said engaged position and a non-locking position in which said second latch member permits said first latch member to pivotally move from said engaged position to said non-engaged position, said first and second latch members respectively having engaging surfaces mutually engaging when said second latch member is in the locking position, said second latch member comprising two side walls and a linking wall bridging therebetween and having an axis of pivotal movement that passes transversely through said two side walls, said linking wall having thereon the engaging surface of the second latch member, and the engaging surface of the first latch member extending into a space between said two side walls, the engaging surface of the first latch member moving away from the axis of pivotal movement of the second latch member when the first latch member moves from the engaged position to the non-engaged position.

4. A safety belt according to claim 3, wherein the axis of pivotal movement of the second latch member is located nearer to the tang than the engaging surfaces of said first and second latch members.

5. A safety belt buckle according to claim 3, further comprising an operating member mounted on said base for engaging the second latch member upon operation thereof to guide said second latch member to the non-locking position, said operating member comprising a first engaging portion for engaging the second latch member in the locking position to prevent the movement thereof to the the non-locking position while the operating member is kept inoperative.

6. A safety belt buckle according to claim 3, further comprising urging means mounted on said base for urging the second latch member toward the locking position, said urging means forcing the second latch member to engage a part of the first latch member having moved to the non-engaging position.

7. A safety belt buckle according to claim 6, wherein said tang comprises an ear portion, said first latch member further comprising a protrusion engageable with said ear portion upon insertion of the tang, the engagement of said ear portion and said protrusion generating a rotational moment which effects the rotation of the first latch member to the engaging position against the urging force of the urging means.

8. A safety belt buckle having a tang, a base member into which said tang is inserted, a first latch member mounted on said base member for pivotal movement between an engaged position in which said first latch member is engaged with said tang and a non-engaged position in which said first latch member is unengageable with said tang, a second latch member mounted on said base member for pivotal movement between a locking position in which said second latch member holds said first latch member in said engaged position and a non-locking position in which said second latch member permits said first latch member to pivotally move from said engaged position to said non-engaged position, said first and second latch members respectively having engaging surfaces mutually engaging when said second latch member is in the locking position, the engaging surface of the first latch member moving away from the axis of pivotal movement of the second latch member when the first latch member moves from the engaged position to the non-engaged position; and an operating member mounted on said base for engaging the second latch member upon operation thereof to guide said second latch member to the non-locking position, said operating member comprising a first engaging portion for engaging the second latch member in the locking position to prevent the movement thereof to the non-locking position while the operating member is kept inoperative, and wherein said operating member further comprises a second engaging portion which acts on the first latch member toward the non-engaging position after the second latch member moves to the non-locking position.

* * * * *